US006773191B2

(12) United States Patent
Killion

(10) Patent No.: US 6,773,191 B2
(45) Date of Patent: Aug. 10, 2004

(54) LIGHTED WRITING DEVICE

(76) Inventor: Thomas Killion, 5534 Woodacre Ct., Indianapolis, IN (US) 46234

( * ) Notice: Subject to any disclaimer, the term of this patent is extended or adjusted under 35 U.S.C. 154(b) by 0 days.

(21) Appl. No.: 10/441,680

(22) Filed: May 20, 2003

(65) Prior Publication Data

US 2003/0235456 A1 Dec. 25, 2003

Related U.S. Application Data

(60) Provisional application No. 60/382,304, filed on May 21, 2002.

(51) Int. Cl.[7] ..... B43K 29/00
(52) U.S. Cl. ..... 401/195; 401/52
(58) Field of Search ..... 401/195, 52

(56) References Cited

U.S. PATENT DOCUMENTS 4,028,540 A * 6/1977 Key et al. ..... 362/118
4,167,347 A 9/1979 Hoyle
4,526,547 A 7/1985 Rusk
4,832,604 A 5/1989 Rusk
5,673,996 A * 10/1997 Ducker ..... 362/118

FOREIGN PATENT DOCUMENTS

GB 1118069 A * 6/1968
GB 1581835 B1 * 12/1980
GB 2212449 A * 7/1989

* cited by examiner

*Primary Examiner*—Gregory L. Huson
*Assistant Examiner*—Huyen Le
(74) *Attorney, Agent, or Firm*—E. Victor Indiano; Indiano Vaughan Roberts & Fuomena, LLP

(57) ABSTRACT

A lightable writing instrument includes a first end portion including a colorant dispenser, and a middle portion including a component housing. A second end portion of the wriging instrument includes a generally tubular body portion having an interior passageway therein. A lightable filament is disposed in the interior passageway and extends along a portion of the interior passageway.

25 Claims, 6 Drawing Sheets

LIGHTED WRITING DEVICE

CLAIM OF PRIORITY

This application claims priority to Thomas Killian, U.S. Provisional Patent Application No. 60/382,304, which was filed on May 21, 2002.

TECHNICAL FIELD OF THE INVENTION

The present invention relates to writing devices, and more particularly to a lighted writing device, and most particularly to a lighted device having a shaped head portion at its top.

BACKGROUND OF THE INVENTION

A myriad of writing instruments exist. In particular a myriad of stick-pen-type writing instruments exist, such as the popular Bic® brand stick-type pens. Typically, a stick pen comprises a tubular body having an open first end and a closed second end. An ink-filled barrel, is coupled to a colorant delivery system, such as a ballpoint dispenser that dispenses an ink-type colorant. In a pencil type writing instrument, the colorant dispenser would comprise a graphite based pencil lead. The ink-containing barrel is inserted into the open end of the hollow tubular body, and frictionally engaged thereto. The ink dispensing member, such as the ball, extends axially outwardly past the tubular body, and is positioned for engaging a sheet of writing material, such as paper.

The ball-shaped ink dispenser is disposed at the very end of the ink dispenser, and actually engages the paper. Through means well known, the ball dispenses ink onto the paper in response to the frictional engagement of the ball with the paper, as the ball is moved along the paper, and rolls within its ball capture.

In recent years, a variation-on the stick pen has been sold by the Killion Corporation d/b/a The Bentcil Company of Indianapolis, Ind., wherein the stick pen includes a decorative head portion at its distal (top) end. The decorative head portion often appears as a creative and fanciful shape, such as a star, a heart, an alligator or an outline of a shirt. Examples of such shape-topped stick pens can be seen at www.bentcil.com.

A shape headed pen usually comprises a stick pen having a tubular body portion that has been elongated, although normal-length tubular bodies can be used. For example, a typical Bic® brand stick pen has a body portion that is approximately 5.25 inches long. By comparison, a shape headed stick pen may utilize a body portion having a length, for example, of 11 to 14 inches. The body undergoes a forming operation so that the top (head) portion of the body is formed into a fanciful and decorative non-linear shape, while the lower portion of the body is allowed to remain linear. Usually, the linear lower portion of the finished shape pen will have a length that is generally similar to the length one might expect of a typical non-shape-topped pen.

Although the shape headed pen may be formed from a tubular body member having an initial length of between 11 and 14 inches, the finished pen will typically have an overall length that is substantially shorter. For example, the finished length may only be 7 to 10 inches in length, when measured in a straight line from the top of the shaped head to the ink-dispensing ball. The overall length is shortened from the original 11 to 14 inches since the shaped-top is formed by bending the upper portion into any one of a large variety of shapes that contain non-axially extending portions. For example, among the shapes into which the pens can be formed are shapes of letters, numbers, symbols such as $, hearts, hands, horses, ice skates, ice cream cones, houses, sharks, dolphins, hard hats, peppers, automobiles, outlines of states and countries, cartoon characters, and the like.

Over the years, the Applicant's products have enjoyed significant success in a wide variety of markets, including for example, the mass merchandise market, and the "souvenir market". Additionally, a large market for such products also exists within the promotional products market, often known as the advertising speciality market. Advertising speciality products comprise products that are purchased by a company for use in promoting the company's non-related products. To this end, customers have purchased pens and pencils having hockey stick-shaped heads to promote ice hockey teams and ice hockey-theme restaurants; body outline-shaped heads to promote coroners' services; animal shapes to promote political parties; tool shapes to promote hardware stores, shark shapes to promote legal services; and logo-shapes to promote a company's products through the use of its logo.

In order to form the head shape of a pen having a shape headed pen, the upper portion of an elongated pen body is heated, so that it becomes bendable. Forms and/or molds may or may not be provided around which the body can be bent to help the manufacturer bend the body into the appropriate shape. The body is then cooled, so that the body portion loses its bendability and the shape of its head becomes fixed.

Although the discussion above has related to pens having a shaped top, pencils having plastic (as opposed to wood) barrels can also be bent in order to have shaped heads.

The Applicant and the company that he founded, the Killian Corporation has had great success in selling such shape-containing writing instruments. Merchandisers have found such shaped pencils and pens to be popular items for patrons to purchase, especially at gift shops in entertainment attractions, such as theme parks, ball parks, tourist-type venues and the like. Additionally, the Applicant and the Killion Corporation have had great success in selling such theme-shaped writing instruments within the advertising speciality market, to companies and groups that use the pens to promote their goods or services.

Notwithstanding the significant sales success and appeal of these products, room for improvement still exists. In particular, room for improvement exists in providing a product that is different, and new, when compared to the shape headed pencils and pens discussed above.

The Applicant has found that product uniqueness and utility are very prized features of products within the gift and advertising speciality markets. Although the prior art shape headed pens and pencils described above have great utility, and are very unique, it is beneficial to provide a product that has similar utility to the prior art writing instruments described above, but which is unique, and different when compared to these prior art writing instruments.

Uniqueness is prized because one of the goals of such advertising speciality products is to capture the attention of the persons to whom they are given, as these persons are often existing or potential customers of the company purchasing the shape headed writing instruments. By capturing the attention of the recipient of the pen, the recipient of the pen will tend to remember the product advertized on the pen for a longer period of time. By better remembering the advertised product (or service), it is hoped that the recipient will also remember the company when the person is in the market to purchase a product of the type advertized on the pen, and that this memory will positively affect the recipient's buying decision.

As such, since a positive correlation likely exists between the uniqueness and utility of the product, and the impact that it makes upon the recipient's buying decisions, a unique product, especially within the advertising speciality market, may benefit the company whose products are advertised with the shaped head writing instruments.

One way of making such a writing instrument unique, is to make the writing instrument lighted.

Lighted writing instruments are believed to have existed prior to the present invention. One method of making such a lighted writing instrument is to provide a generally solid piece of a clear or tinted methyl methacrylate, and to affix a bulb at one end thereof. The light emanating from the bulb passes through the methyl methacrylate in a tube-lighting or fiber optic-type manner.

Although such lighted pens have some desirable characteristics, room for improvement exists. In particular, it is the Applicant's belief that such tube-lighting type lighted pens do not often provide good lighting characteristics, as the "tube" of the tube lighted pen does not transmit light well around the complex bent shapes that are often employed in shape headed writing instruments. Additionally, the lighting effects that can be achieved with tube lighting are limited. As such, room for improvement exists in the delivery of the lighting effect produced by lighted pens.

One object of the present invention is to provide a lighted writing device wherein the writing device becomes lighted along the substantial length of the body portion, to produce an enhanced lighting effect, when compared to some known prior art lighted pens.

SUMMARY OF THE INVENTION

In accordance with the present invention, a lightable writing instrument comprises a first end portion including a colorant dispenser. The instrument also includes a middle portion including a component housing; and a second end portion including a generally tubular body portion having an interior passageway therein. A lightable filament is disposed in the interior passageway and extends along a portion of the interior passageway.

A shaped head portion can be disposed at the distal end of the body portion, and is preferably integral with the body portion.

Preferably, the body portion is generally hollow and tubular, and is comprised of a transparent or translucent material, that may either be clear or tinted to impart color to the body portion. A lighted filament member extends through the interior of the body portion, and into at least a portion of the non-linear shape. The filament member is capable of emitting light along its length. The electrical control portion includes a power source for providing electrical power to the filament, to cause the filament to emit light when so actuated to do so.

One feature of the present invention is that a light emitting filament is disposed within the hollow interior of the body portion, to extend into the shaped distal (head) end of the writing instrument. Preferably, the filament is designed so that it can emit light along its length. This feature has the advantage of being capable of providing a pen wherein light is emitted along most of the length of the distal portion writing instrument, including the entire length of the shaped head portion, if so desired.

Alternately, portions of the lighted filament can be shrouded or substituted with another material, so that the light emitting portion of the pen body is confined to a certain area. In this way, for example, the filament can be shrouded along the generally linear, hand-engaging portion of the body portion of the pen, but uncovered in the shaped head portion, so that the shaped head alone emits light along its length, while the generally linear, hand-engaging portion of the body portion remains dark.

Another feature of one embodiment of the present invention is that it can include an enlarged diameter electrical component casing disposed near to, but in a spaced relation from the point of the pen. This feature has a dual advantage. First, it provides a casing for housing the electrical components, such as the batteries, switch, connectors, and associated operational circuitry. Second, it provides an enlarged diameter gripping surface, of the type that many believe to increase the comfort of a person writing with the writing instrument.

These and other features of the present invention will become apparent to those skilled in the art upon a review of the drawings presented below, along with a description set forth below that describes the best mode of practicing the invention perceived presently by the Applicant.

DETAILED DESCRIPTION

Figure 1:
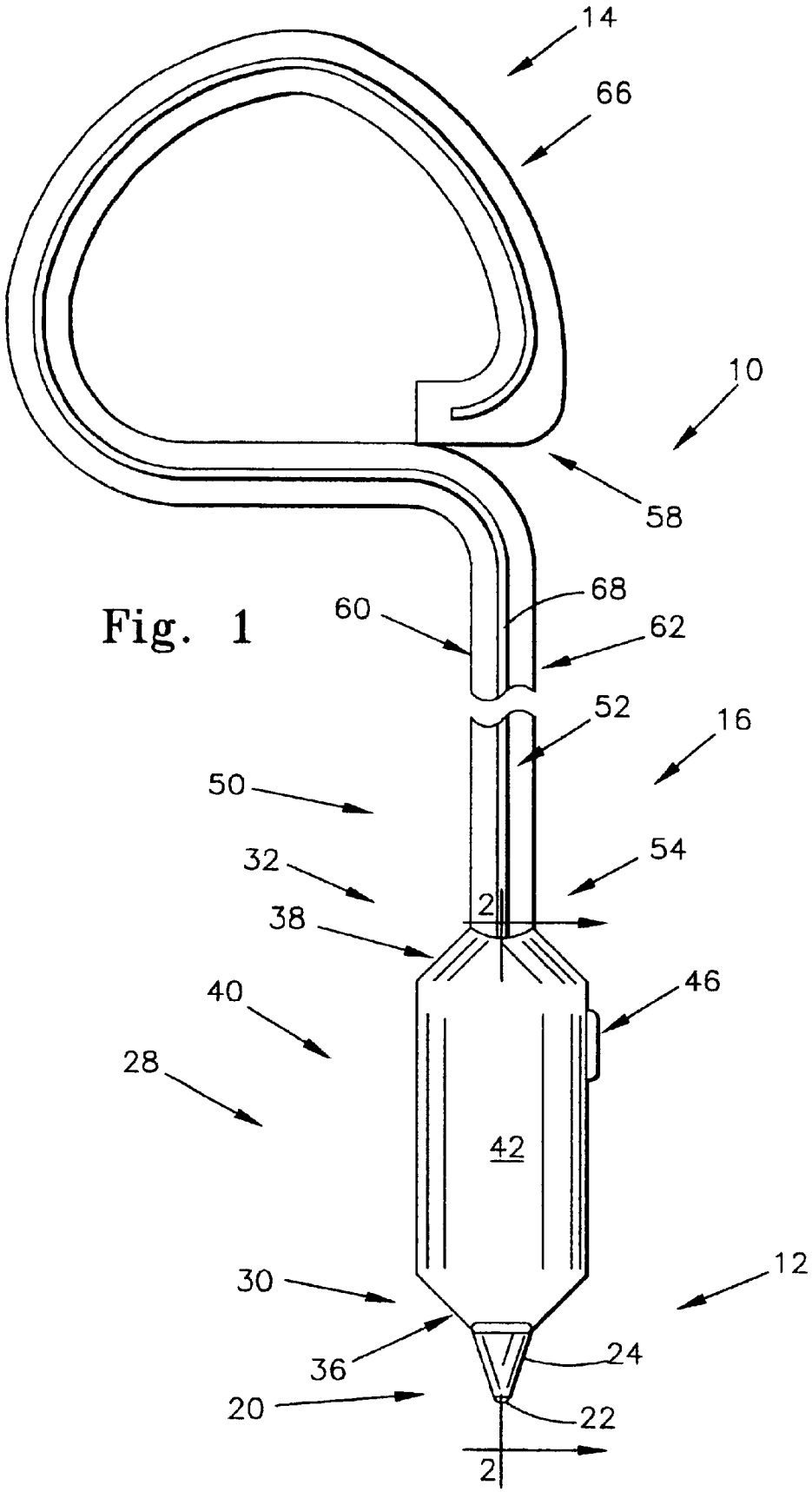
FIG. 1 is a side elevational view of the writing instrument of the present invention.
Figure 2:
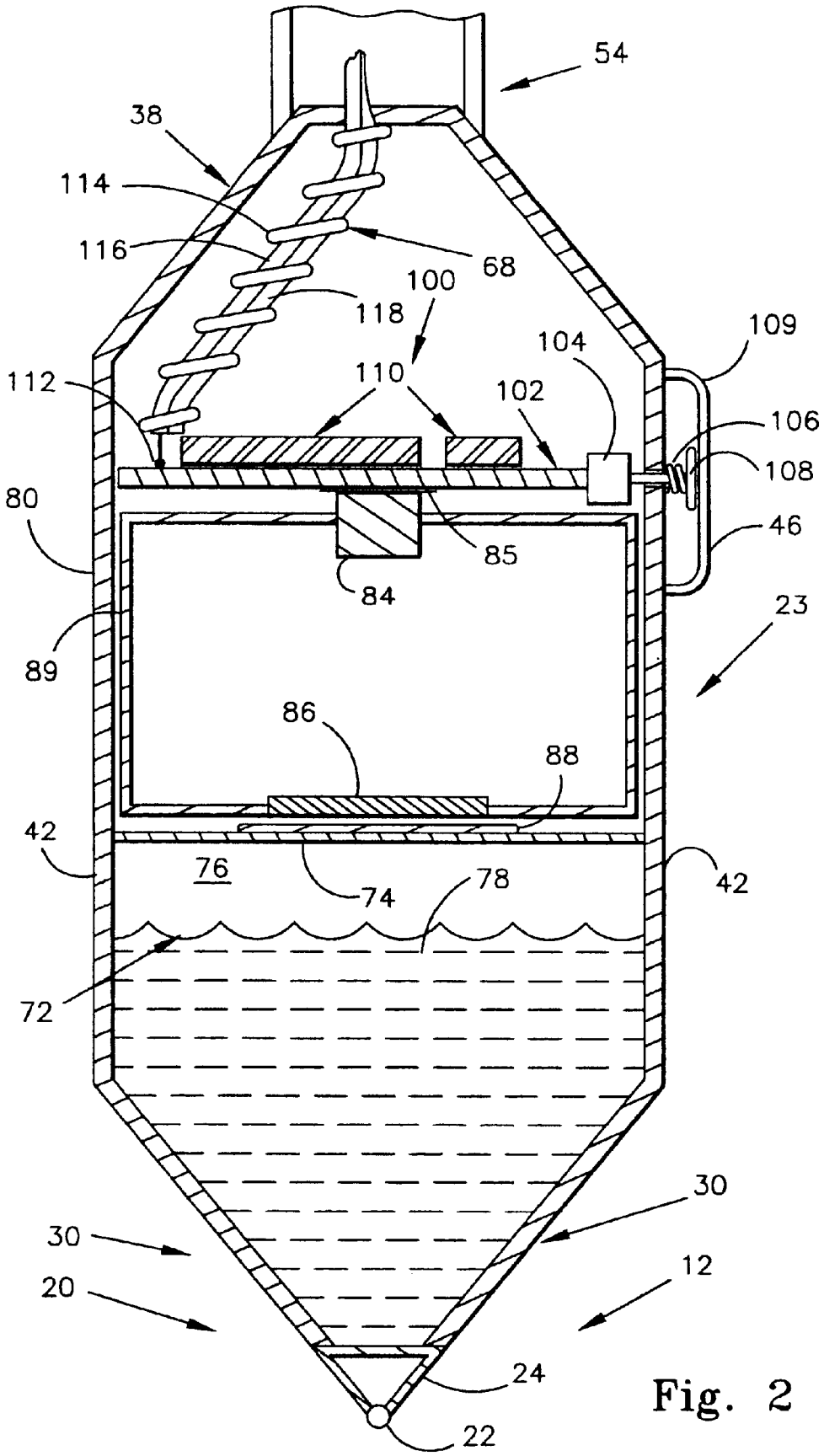
FIG. 2 is a sectional view taken along lines 2—2 of FIG. 1.

The writing instrument 10 of the present invention is best shown in FIGS. 1 and 2 as including a first, or proximal end 12; a second, or distal end 14; and middle portion 16 disposed therebetween. The first end 12 includes an ink dispenser, and is the end of the writing device 10 that engages the paper or other writing surface. The ink dispenser 12 is shown in the drawings as comprising a ballpoint or roller-ball type ink dispenser 20, that includes a roller-ball 22 that is held within a generally, frusto-conically-shaped ball capture 24. The ball capture 24 contains ink within its interior (as will be explained below), and is fixedly coupled, or alternately, detachably coupled to a housing 28 through a snap-fit or friction-fit arrangement. Housing 28 contains a power source, a reservoir of ink, and a circuitry for operating the lighted writing device 10.

The housing 28 has a generally enlarged diameter relative to the rest of the pen, and includes a first, or proximal end 30, and a second, or distal end 32. The proximal end 30 includes a frusto-conically shaped surface 36 that tapers inwardly to mate in diameter with the large end of the frusto-conical ball capture 24. Although the frusto-conically-shaped surface 36 is shown in the figures as terminating at the ball capture, the proximal end of the frusto-conically shaped surface 36 may be disposed in a spaced relation from the all caption, such as by being separated therefrom by a distance of a centimeter or so. Similarly, the second or distal end 32 also includes a generally frusto-conically shaped surface 38 that tapers radially inwardly to mate with the first or lower end of a generally tube-like body portion 50.

A cylindrical, finger-engaging middle portion 28 is disposed between the lower 36 and upper 38 frusto-conical surfaces. The middle portion 28 is generally cylindrical in configuration, and includes an axially extending, radially outwardly facing cylindrical surface 42.

Alternately, the middle portion can have a triangular cross section or other, non-cylindrical cross section. The elongated diameter and cross sectional shape of the middle portion are preferably designed both to have sufficient interior volume to hold the battery, switch and electronic components contained therein (see below) and also to provide a comfortable gripping surface for the user. In this regard, it is believed by many that an enlarged diameter gripping surface (e.g. greater than 1 cm.) is more comfortable for a user, and produces less fatigue and cramping than the relatively thinner (e.g. less than 1 cm.) gripping portion of traditional pens. See, e.g. Hoyle, U.S. Pat. No. 4,167,347; Rusk, U.S. Pat. No. 4,526,547; and Rusk U.S. Pat. No. 4,832,604.

Typically, the user grips the writing instrument by gripping either the cylindrical surface 42, or the lower frusto-conical surface 36 with his fingers to grab the writing instrument 10 when he desires to write. A switch actuator 46 is disposed on the radially outwardly facing cylindrical surface 42, and is actuable to permit the user to turn the lighting mechanism of the writing device 10 on and off.

Although the drawings show an external switch actuator 46, other switch configurations can be employed. For example, the outwardly facing cylindrical surface 42 can be comprised of a pliable, plastic or rubber material that the user can squeeze radially inwardly to radially depress a switch actuator (not shown) disposed interiorly of the outwardly facing cylindrical surface 42.

A generally tube-like body portion 50 is disposed distally of the housing 28 and is fixedly, or alternately, detachably coupled to the second end 32 of the housing 28. The tube-like body portion 50 is preferably formed from a thermoformable plastic material, having a hollow interior 52. The thermoformable plastic material should be of the type that is designed to allow light to pass therethrough. As such, the tube-like body portion 50 can either be transparent, or translucent.

In a preferred embodiment, the body portion 50 is tinted with a coloring agent to improve the aesthetic appearance of the device, both when the device 10 is lit, and when the light is not on. For example, tinting body portion 50 with red, while still maintaining its general transparency, in a manner similar to a red-tinted lens, will give the body portion 50 a red appearance when the light is off. When the light within the body portion 50 is illuminated, the light being emitted within the interior of the tube-like body portion 50, which is usually a white light, will appear to be red due to the tinting of the body portion 50.

The hollow, axially extending interior cavity 52 of the tubular body portion extends generally throughout the length of the tubular body portion 50. It should be noted that although the body portion 50 is denoted as being tubular, the body portion 50 need not be cylindrically tubular. Rather, during the bending operation that creates the theme shape 66, certain portions of the tubular body 50 may become somewhat crimped and flattened, so that the hollow interior has a more ovaloid or slit-like cross section, rather than a generally circular cross section. Additionally, it should be noted that the cross sectional shape even of the non-bent portion of the body portion 50 is not limited to a circular cross section, but may have any desired cross sectional shape, such as rectangular, triangular, elliptical, ovaloid, peanut-shaped, or the like, depending upon the whims and desires of the manufacturer of the device and the manufacturer's potential customers.

An example of such transparent, tintable material would comprise a methyl methacrylate polymer, along with other plastic materials. The plastic material from which the tubular body 50 is made should be temperature-stable at normal ambient room temperature, but should be capable of softening to facilitate bending of the tubular body 50 at temperatures typically induced by a heater. It will be appreciated that the use of a plastic that does not begin to soften until significantly higher temperatures are achieved may not be especially desirable, as such a high temperature melting plastic would require the body to be heated to a higher temperature to bend it around the mold, which would require a greater energy, input longer heating time, and greater temperature resistant handling materials (e.g. special gloves) to prevent the manufacturing personnel from becoming burned during the shaping of the writing instrument.

The tube like body 50 includes a generally linearly extending portion 62, that is disposed adjacent to the first or proximal end 54 of the tubular body portion 50. The linearly extending portion 62 is sized and positioned to engage the user's hand. Typically, when griping the writing instrument, the user will place his fingers on the radially outwardly facing cylindrical surface 42 of the housing 28, and will rest the radially outwardly facing surface 60 of the linear portion 62 against the webbing of his writing hand, which generally comprises that portion of the hand between the user's thumb and forefinger. The non-linear shaped head portion 66 is disposed at the second end 58 of the body portion 50. Importantly, the body portion 50 should generally have some hollowness throughout its length, for receiving a luminescent filament 68, that is disposed within the hollow interior cavity 52, and extends along substantially the entire length of the body portion 50.

The luminescent filament comprises a fiber wire containing phosphorous having a center conductor that is preferably made of copper. Another conductor that is spirally-wrapped around the outside of the phosphorous-containing fiber. When current is applied to the exterior, spirally wound conductor, energy travels from the spirally wound conductor, through the wrap of the fiber and through the phosphorous to the core conductor. This causes the phosphoreus within the fiber wrap to illuminate, thereby emitting light.

The fiber wrapped filament 68 is relatively thin, and in one embodiment has an overall diameter of about 2.2 mm., including the spirally-wound outer conductor.

In order to cause the luminescent filament 68 to glow, current must be applied to the outer, spiral conductor. Depending upon how the current is applied to the luminescent filament 68, the luminescent filament 68 can be designed to glow continuously, or to glow intermittently to thereby flash. Importantly, the luminescent filament 68 will glow along its entire length. As such, the writing device 10 can be designed so that luminescent filament 68 will emit a glow along the entire length of the body portion 50 of the writing device 10, when the luminescent filament extends through the entire length of the body portion. The continuously hollow nature of the body portion 50 permits the luminescent filament 68 to extend throughout the entire length. Preferably, this "entire length" does not include the last centimeter or so of the length, to permit some spacing between the end of the filament 68 and the end of the tubular body portion 80.

Alternately, non-glowing conductors can be substituted for the luminescent filament 68, in portions of the body portion 50, so that these non-luminescent portions will not glow. In this way, the writing device 10 can be designed so that only selected portions glow, while the other positions of the filament become non-light emitting portions. For example, a regular, non-luminescent wire can extend between the housing 28 and the first bend 70 that defines the beginning of the theme-shaped head 66. The luminescent filament 68 can start at bend 70, and can continue to the second or distal end 58 of the theme portion 66 so that only the shaped head portion 68 emits light, while the linear portion 62 does not emit light. As an alternative to non-luminescent filament to substitute in the desired darkened areas, the luminescent filament 68 can be shrouded in certain portions to achieve the same basic effect, wherein only segments of the body portion 50 are selectively lit.

The interior of the housing 28, the electrical control components, the ink and the power supply are best shown with reference FIG. 2. An ink reservoir 72 is disposed adjacent to the ball capture 24, and includes a cap member 74, that defines a hollow interior 76, in which an ink supply 78 is disposed. The ink may be a conventional ink such as any one of the various pen-type inks currently used. The choice of the particular ink used will depend upon the nature of the dispensing system, and the intended purpose of the ink.

The housing 28 also includes a battery housing portion 80, that, in the embodiment shown is disposed generally distally to the ink reservoir 72. The battery housing portion 80 contains a battery 82 having a positive terminal 74 that contacts a positive terminal receptor 85 that is coupled to circuit board 102; and a negative terminal 86 that is placed in electrical contact with a negative terminal receptor 88.

The electrical control device 100 is shown as comprising a circuit board 102, having suitable components thereon to perform the functions necessary to cause the luminescent filament 68 to emit light, to turn off, and to exhibit those lighting properties desired by the user and/or manufacturer. A switch 104 is coupled to the circuit board 102 and includes a spring 106 loaded actuator 108. The actuator 108 permits the user to actuate the switch 104 between an on and an off position or, preferably, between a continuous-on, a flash-on and an off position, as will be discussed in more detail in connection with FIG. 3. A pliable rubber or plastic cover 109 overlays the actuator 108, and the circuit board 102 includes a plurality of circuit components, as will be described in more detail in FIG. 3.

The first end 112 of the luminescent filament 68 is also electrically coupled to the circuit board 102. The luminescent filament 68 is shown in FIG. 2 as including the outer, spirally-wrapped conductor 114, the inner, core conductor 116, and the phosphorous-containing wrap portion 118 that were described in more detail above. As discussed above, current is passed through the outer, spirally-wrapped conductor 114, and passes through the phosphorous-containing portion 118, ultimately finding its way to the core conductor 116. The current passing through the phosphorous-containing portion 118, causes the phosphorous to glow, thereby emitting light, and thereby causing the filament member 68 to serve as a light-emitting filament.

Figure 3:
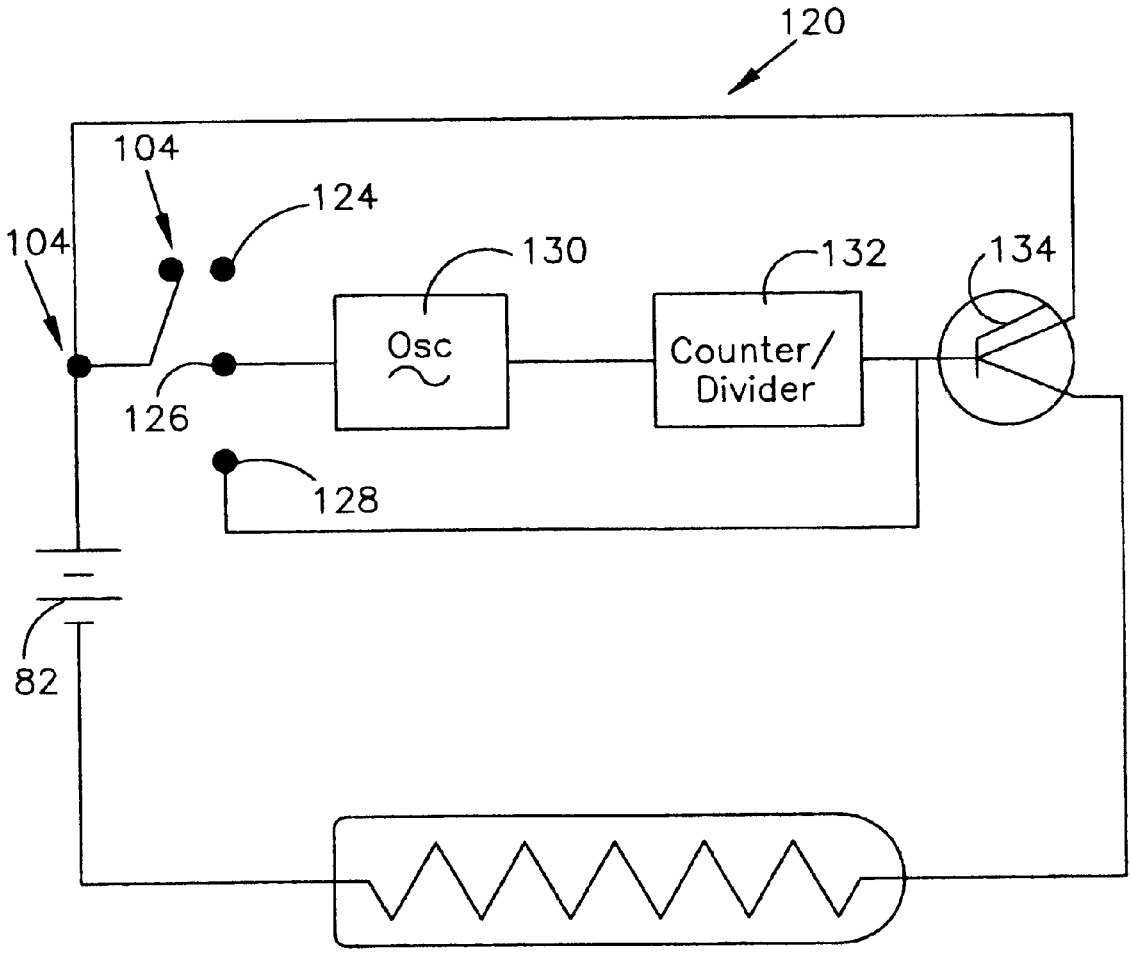
FIG. 3 is a schematic view of the electrical circuit used in connection with the writing instrument of the present invention.

Although a variety of circuits can be used, depending upon size, economic and performance considerations, an exemplary circuit 120 is schematically represented in FIG. 3. The circuit 120 of FIG. 3 includes the luminescent filament 68, and the battery 82 that provides direct current and power for the operation of the circuit 120. The switch 104 comprises a three-position switch, containing a first (off) position 124, a second (flash) position 126, and a third (continuous-on) position 128.

In FIG. 3, the switch 104 is shown in the first position 124, where no current is being passed through the circuit. As such, no current is being passed through the luminescent filament 68, and therefore the luminescent filament 68 will not glow. When the switch 104 is moved to the third position, to contact with the third pole 128, current will flow from the battery 82, through the transistor 134, and ultimately through the luminescent filament 68, to cause the luminescent filament 68 to glow on a continuous basis.

The circuit 120 shown in FIG. 3 has a third mode of operation, wherein the luminescent filament 68 will flash on and off. This occurs when the switch 104 is in the second position 126, so that the current is caused to flow through an oscillator 130 and a counter/divider 132. The passage of current through the oscillator 130 and the counter/divider 132, causes the luminescent filament 68 to flash on and off. The flash duration and flash frequency can be varied through the choice of the particular counter/divider 132 employed.

It will be appreciated that analogous components can be used in place of the components of circuit 120 shown to achieve the same function; or alternately, to achieve lighting effects that are different from those described above.

To manufacture the device 10, the various components of the ink dispensing system and electrical control are designed and assembled into the housing portion 28. The luminescent filament 68 is then fed through the hollow interior 52 of the body portion 50, to extend substantially all of the way through the body portion. At this point in the process, the body portion is generally linear, as the shaped head has not yet been formed. The second or proximal end of the body portion is then heated to an appropriate temperature to make it thermo-formable. When so heated, the second end of the body portion 50 is placed on a forming mold, and bent around the mold, to achieve the desired shape, while the luminescent filament 68 is still contained therein.

As shown in the drawing, shaped head 66 is generally ovaloid or egg shaped. However, shapes other than that shown in FIG. 1 are possible, and are limited largely by only the imagination of the manufacturer and, to some extent, the need for a shape that can be made from a generally continuous member. Additionally, a generally sheet-like banner member can be disposed within the interior of the theme-shape to display a two-dimensional message.

Figure 4:
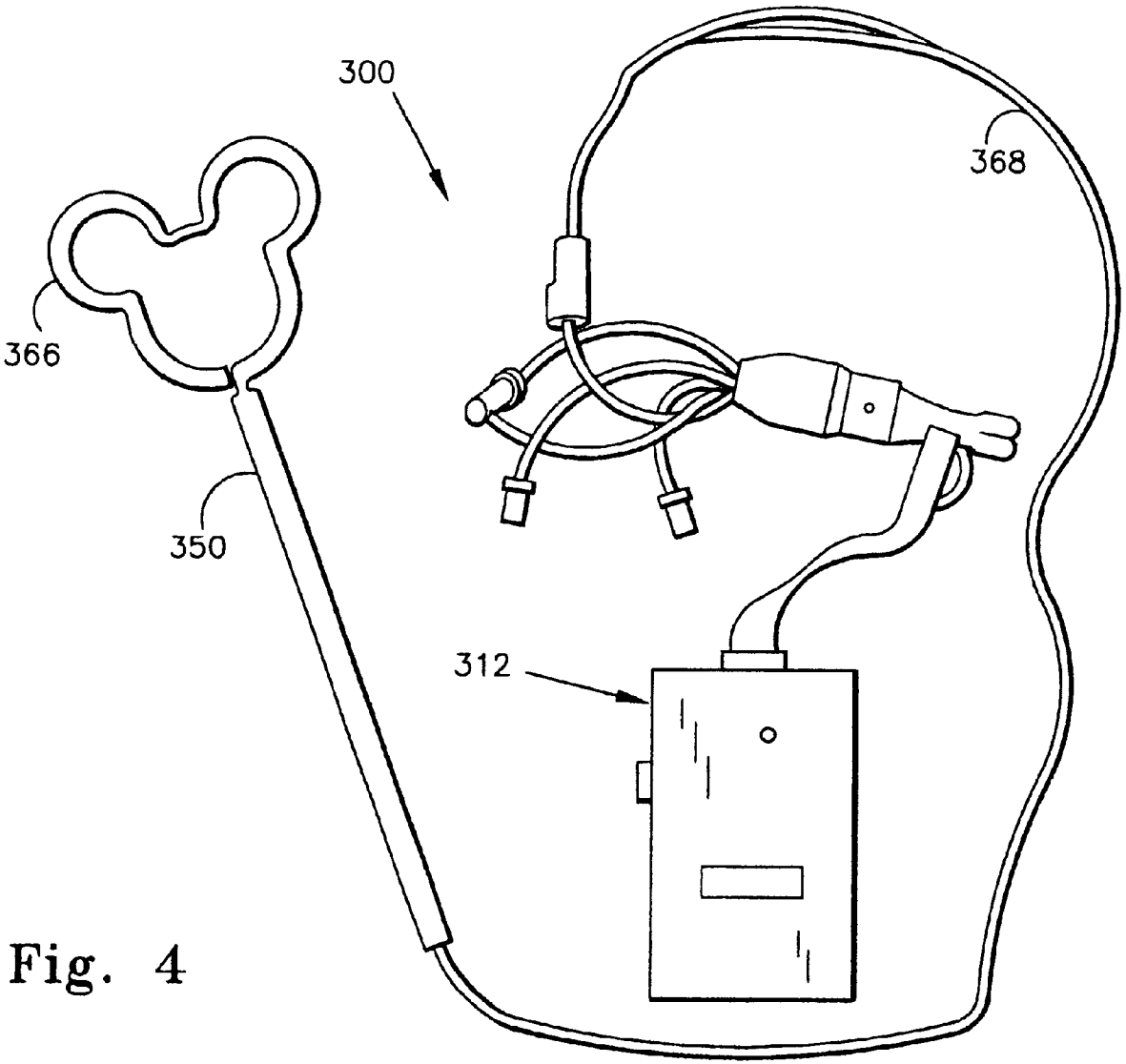
FIG. 4 is a reproduction of a non-working test prototype of the present invention.

Finally, your attention is directed to FIG. 4, that shows the prototype device 300. Slowly the pen body 350 with its shaped head 366, the luminescent filament 368, and the electrical control device 312 contains the battery (not shown). It will be noted in FIG. 4 that the electrical control device 300 is generally about the size of a pack of 70 mm cigarettes, and the wiring 312 leading from the electrical control device is ribbon-type wire, having a size and dimension not that much smaller than the ribbon-like circuit board cable contained within a personal computer, to couple a motherboard to various other circuit boards within the computer. The purpose of illustrating the prototype device 300 is both to illustrate the fact that the device can function, and to suggest the difficulties encountered in transforming the components shown in FIG. 4 into a sub-miniature package capable of being contained within a useable, stick-like writing device.

The writing instrument 210 including a first, or proximal end 212; a second, or distal end 214; and a middle portion 216 disposed therebetween. The first end 212 includes an ink dispenser, and is the end of the writing device 210 that engages the paper or other writing surface. The ink dispenser 212 is shown in the drawings as comprising a ballpoint or roller-ball type ink dispenser 220, that includes a roller-ball that is held within a generally, frusto-conically-shaped ball capture 224. The ball capture 224 is fixedly coupled, or alternately, detachably coupled to a component housing 228 through a snap-fit or friction-fit arrangement. Housing 228 contains a power source, a tubular reservoir of ink 229, and circuitry for operating the lighted writing device 210.

The component housing 228 has a generally enlarged diameter relative to the rest of the pen, and includes a first, or proximal end 230, and a second, or distal end 232. The proximal end 230 includes a frusto-conically shaped surface 236 that tapers inwardly to mate in diameter with the large end of the frusto-conical ball capture 224. Similarly, the second or distal end 232 also includes a generally frusto-conically shaped surface 238 that tapers radially inwardly to mate with the first or lower end of a generally tube-like body portion 250.

A triangular in cross-section, finger-engaging middle portion 237 is disposed between the lower 236 and upper 238 frusto-conical surfaces. The middle portion 237 includes three axially extending, radially outwardly facing rectangular surfaces 242, that comprise three, generally rectangular finger engaging surfaces.

Alternately, the middle portion 237 can have a cylindrical cross section or some other cross section. The elongated diameter and cross sectional shape of the middle portion 237 are preferably designed both to have sufficient interior volume to hold the battery 245, switch 247 and electronic components 253 contained therein (such as the oscillator and counter/divider described above) and also to provide a comfortable gripping surface for the user. Typically, the user grips the writing instrument by gripping the surface 242 of the middle portion 238 with his fingers to grab the writing instrument 210 when he desires to write. A switch actuator 246 is disposed just underneath the radially outwardly facing surface of the middle portion 237, and is actuable by radially directed movement to permit the user to turn the lighting mechanism of the writing device 210 on, off and optionally to a "flash" position.

Preferably, the surface 242 of the middle portion 238 is comprised of a pliable plastic or rubber material that the user can squeeze radially inwardly to radially depress a switch actuator 247 that is disposed interiorly of the outwardly facing surface 242.

A generally tube-like body portion 250 is disposed distally of the component housing 228 and is fixedly, or alternately, detachably coupled to the second end 232 of the housing 228. The tube-like body portion 250 can either be transparent, translucent, or partially transparent and/or translucent with opaque segments. In a preferred embodiment, the body portion 250 is tinted so that the light emitted from the interior comprises a colored light.

The hollow, axially extending interior passageway 252 of the tubular body portion 250 extends generally throughout the length of the tubular body portion 250. It should be noted that although the body portion 250 is denoted as being tubular, the body portion 250 need not be cylindrically tubular as discussed above.

The plastic material from which the tubular body 250 is made should be temperature-stable at normal ambient room temperature, but should be capable of softening to facilitate bending of the tubular body portion 250 at temperatures typically induced by a heater, such as 125° F. or greater.

The tube like body portion 250 includes a first end 251 that is generally linear, and matingly engages the second end 232 of the component housing 228. The middle portion 262 of the body portion 250 extends generally linearly. The linearly extending middle portion 262 is sized and positioned to engage the user's hand, and should be long enough to rest against the webbing of the user's writing hand when the user is holding the writing instrument 210 properly.

The non-linear shaped head portion 266 is disposed at the second end 258 of the body portion 250. Importantly, the body portion 250 should generally be hollow throughout its length so that the interior passageway 252 extends throughout its length, for receiving a luminescent filament 268, that is disposed within the hollow interior passageway 252, and extends along substantially the entire length of the body portion 250.

The luminescent filament 268 is generally similar to luminescent filament described above, and includes a first end 269 having contacts for establishing an electrical coupling with the battery 245. The luminescent filament 268 preferably comprises a fiber wire containing phosphorous having a center conductor that is preferably made of copper. Another outer conductor is spirally-wrapped around the outside of the phosphorous-containing fiber in a manner similar to the spirally wound outer conductor of the luminescent filament 68 described above. The luminescent filament 268 also operates in a manner generally similar to the luminescent filament 68 described above.

The continuously hollow nature of the body portion 250 permits the luminescent filament 268 to extend throughout the entire length of the body portion 250. Preferably, this "entire length" does not include the last centimeter or so of the length of the body portion 250, to permit some spacing between the second end of the filament 268 and the second end of the tubular body portion 250.

Figure 6:
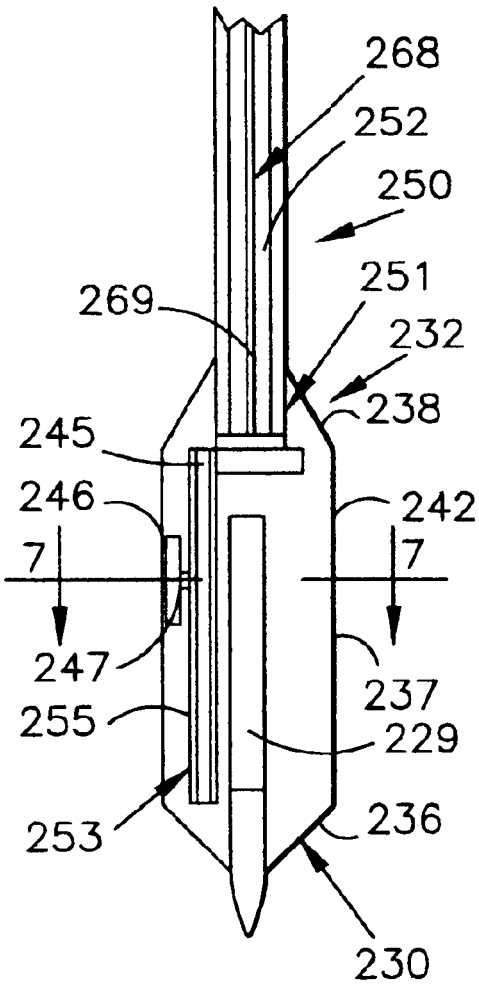
FIG. 6 is a schematic longitudinal sectional view of the first or lower portion of the pen of the present invention.

The interior of the housing 228, the electrical control components, the ink and the power supply are best shown with reference FIG. 6. A tubular ink reservoir 229 is disposed adjacent to and coupled to the ball capture 224 in a manner conventional to stick-type pens. An ink supply is contained within the tubular ink reservoir 229 that may be a conventional ink such as any one of the various pen-type inks currently used. The choice of the particular ink used will depend upon the nature of the dispensing system, and the intended purpose of the ink.

The housing 228 also includes a battery housing that holds the coin shaped battery 245 and includes contacts for electrically coupling the positive and negative contacts of the battery to the first end 269 of the luminescent filament 268. The battery is disposed generally distally to the ink reservoir 229. The battery 245 is electrically coupled to the electrical component containing circuit board 255.

The electrical control device 253 includes the circuit board 255, upon which are placed suitable components to perform the functions necessary to cause the luminescent filament 268 to emit light, to turn off, and to exhibit those lighting properties desired by the user and/or manufacturer. The components 253 are preferably functionally similar to the electrical components discussed in connection with FIGS. 1–4.

Figure 5:
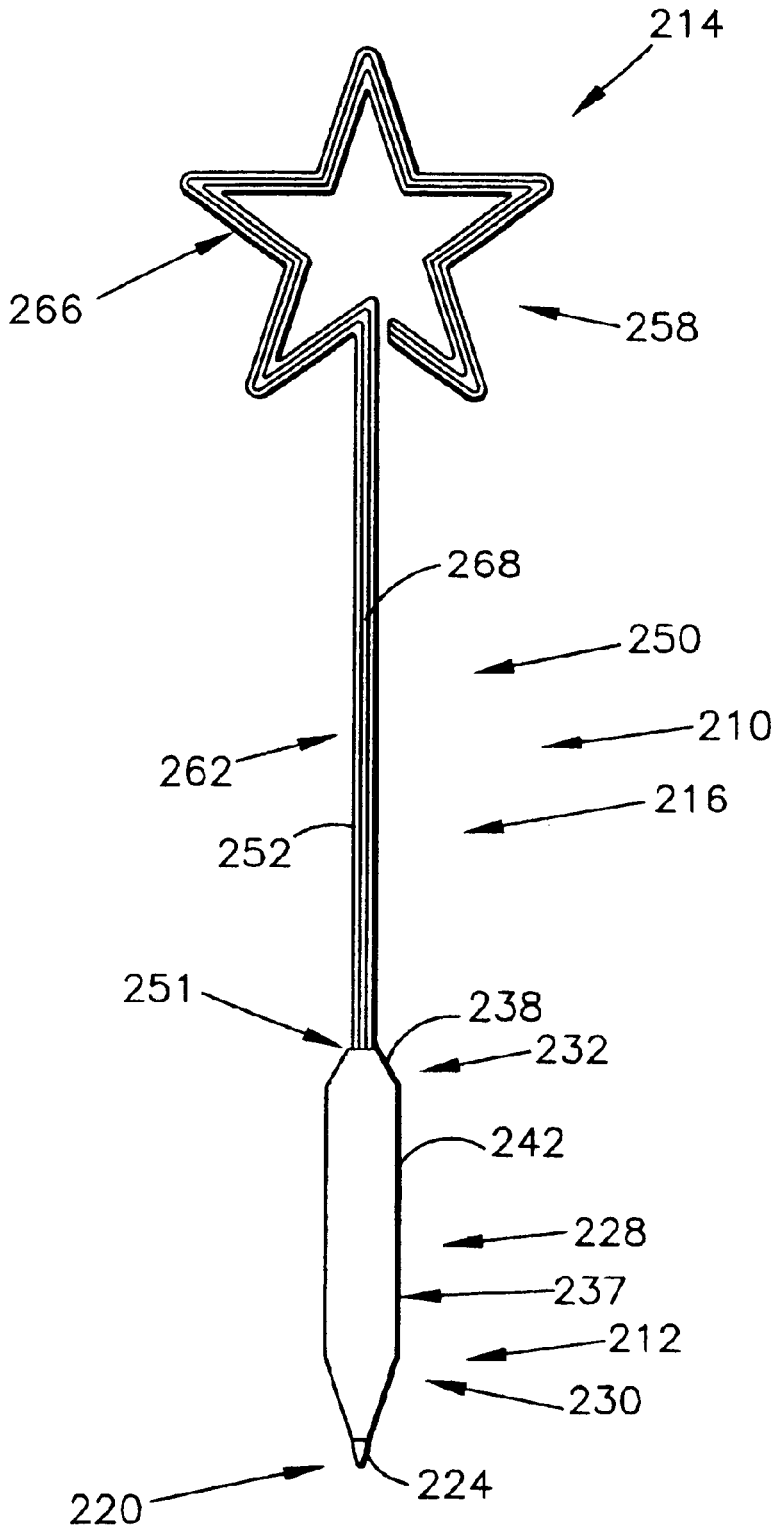
FIG. 5 is a plan view of an alternate, preferred embodiment of the present invention.
Figure 7:
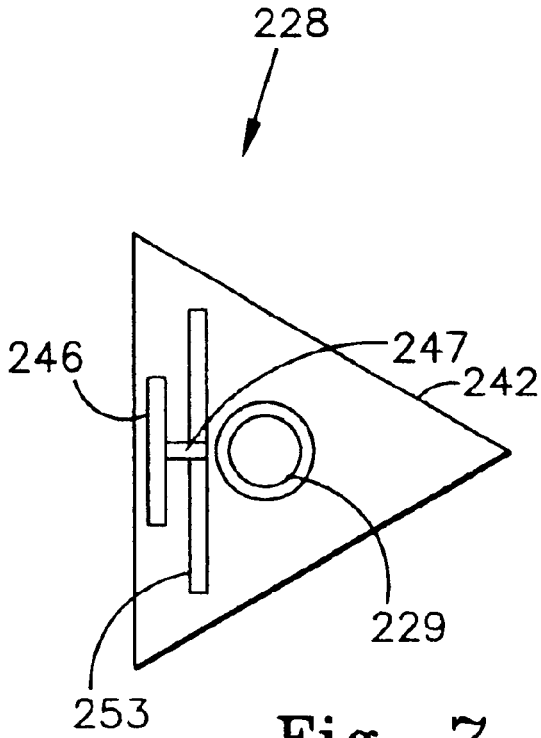
FIG. 7 is a schematic, enlarged lateral sectional view of the component casing of the present invention taken along lines 7—7 of FIG. 6.

The first end 269 of the luminescent filament 268 is also electrically coupled to the circuit board 255. The luminescent filament 268 used in the embodiment of FIGS. 5–7 is identical to the luminescent filament 68 discussed in connection with FIGS. 1–4 and includes an outer, spirally-wrapped conductor, inner core conductor, and a phosphorous-containing fiber. The switch 247 preferably comprises a three-position switch, containing a first (off) position, a second (flash) position, and a third (continuous-on) position similar to switch 104, to provide the luminescent filament with three modes or configurations of operation including off, on and flash.

The flash duration and flash frequency can be varied through the choice of the particular counter/divider employed.

It will be appreciated that analogous components can be used in place of the components of the components shown to achieve the same function; or alternately, to achieve lighting effects that are different from those described above.

To manufacture the device 210, the same general process is employed that is described above in connection with FIGS. 1–4.

As shown in the drawing, shaped head 266 is generally non-linear, unlike the linear body portion in FIG. 5, a star shaped head is shown. Although shapes other than that shown in FIG. 6 are possible, and are limited largely by only the imagination of the manufacturer and, to some extent, the need for a shape that can be made from a generally continuous member. Additionally, a generally sheet-like banner member can be disposed within the interior of the theme-shape to display a two-dimensional message.

What is claimed:

1. A lightable writing instrument comprising:

a first end portion including a colorant dispenser, a middle portion including a component housing;

a second end portion including a generally tubular body portion having an interior passageway therein; and a lightable filament disposed in the interior passageway and extending along a portion of the interior passageway.

2. The writing instrument of claim 1 wherein the component housing houses a power source for providing electrical current to the filament, and a switch for enabling a user to selectively deliver current to the filament.

3. The writing instrument of claim 2 wherein the component housing houses control circuitry for controlling the flow of current to the filament.

4. The writing instrument of claim 2 wherein the control circuitry is capable of controlling the flow of the current to enable the filament to emit light in each of a constant-on and a flashing configuration.

5. The writing instrument of claim 4 wherein the control circuitry includes an oscillator and a counter/divider for enabling the filament to emit light in each of the constant on and flashing configurations.

6. The writing instrument of claim 2 wherein the power source comprises a battery, further comprising control circuitry coupled to the switch for controlling the flow of current to the filament.

7. The writing instrument of claim 2 wherein the component housing includes an axially extending radially outwardly facing surface having a pliable portion, wherein the switch is disposed interiorly of, and adjacent to the pliable portion.

8. The writing instrument of claim 7 wherein the colorant dispenser includes a reservoir for holding a supply of ink and an ink dispenser.

9. The writing instrument of claim 8 wherein the ink dispenser comprises a ball-type ink dispenser.

10. The writing instrument of claim 1 wherein the colorant dispenser comprises a pencil lead.

11. The writing instrument of claim 1 wherein the body portion includes a first end portion coupled to the component housing a generally lineally extending middle portion, and a generally non-lineally extending shaped head portion.

12. The writing instant of claim 11 wherein the component housing houses an electrical power source and, the filament includes a first end electrically coupled to the power source, a middle portion extending through the generally linear middle portion of the body portion, and a second end portion extending through at least a portion of the non-lineally extending shaped head portion of the body portion.

13. The writing instrument of claim 12 wherein the body portion is comprised of a tubular member composed of a thermoformable plastic that becomes bendable when heated to temperatures of great than about 125° F.

14. The writing instrument of claim 12 wherein the filament extends substantially throughout the entire extent of the first end portion, middle portion and second end portion.

15. The writing instrument of claim 14 wherein the shaped head portion includes a second end of the body portion, and the second end of the filament extends to within about one centimeter of the second end of the body portion.

16. The writing instrument of claim 15 wherein the filament is configured to emit light along substantially its entire length within the body portion.

17. The writing instrument of claim 16 wherein the filament includes at least one non-light emitting segment along its length, for preventing light from being emitted along at least one segment of the body portion.

18. The writing instrument of claim 1 wherein the component housing includes a power source, the tubular body portion includes a first end coupled to the component housing and a second end, and the filament includes a first end coupled to the electrical power source, a middle portion that extends through the interior passageway of the tubular body portion, and a second end disposed in the interior passageway adjacent to the second end of tubular body portion.

19. The writing instrument of claim 1 wherein the filament is configured to emit light along substantially its entire length within the interior passageway of the tubular body portion.

20. The writing instrument of claim 1 wherein the filament is configured to include both light emitting portions and non-light emitting portions, the non-light emitting portions being provided for preventing the emission of light along at least one segment of the body portion.

21. The writing instrument of claim 1 wherein the filament includes a phosphorous containing strip and a conductor disposed adjacent to the phosphorous strip for delivering electricity to the phosphorous strip to cause phosphorous on the strip to emit light.

22. The writing instrument of claim 1 wherein the filament includes a centrally disposed conductor, a supply of phosphorous disposed exteriorly of the central conductor, and an outer conductor disposed exteriorly of the supply of phosphorous, whereby the passage of current in the two conductors causes the phosphorous to emit light.

23. The writing instrument of claim 22 wherein the supply of phosphorous comprises a strip of phosphorous extending along the length of the central and exterior conductors.

24. The writing instrument of claim 23 wherein the exterior conductor is spirally wrapped around the strip of phosphorous for increasing the surface area contact between the exterior conductor and the phosphorous strip.

25. The writing instrument of claim 24 wherein strip of phosphorous comprises a phosphorous containing fiber having the central conductor disposed therein.

* * * * *